US006341780B1

(12) United States Patent
Pant et al.

(10) Patent No.: US 6,341,780 B1
(45) Date of Patent: Jan. 29, 2002

(54) DISC TOSSING GAME

(76) Inventors: Adam Pant; Ryan Pant, both of 9771 N. Six Lakes Rd., Six Lakes, MI (US) 48886

( * ) Notice: Subject to any disclaimer, the term of this patent is extended or adjusted under 35 U.S.C. 154(b) by 0 days.

(21) Appl. No.: 09/439,335

(22) Filed: Nov. 12, 1999

(51) Int. Cl.[7] ..... A63B 67/06
(52) U.S. Cl. ..... 273/401; 273/402; 273/400
(58) Field of Search ..... 273/398–402

(56) References Cited

U.S. PATENT DOCUMENTS

| | | | | |
|---|---|---|---|---|
| 4,927,161 | A | 5/1990 | Brenneman | |
| 4,936,590 | A | 6/1990 | Palmer | |
| 4,974,858 | A | 12/1990 | Knowlton | |
| 5,382,028 | A | 1/1995 | Sciandra et al. | |
| 5,472,211 | A | * 12/1995 | McCaughan | 273/402 |
| D369,188 | S | 4/1996 | Briggs | |
| 5,575,480 | A | 11/1996 | Wehr | |

* cited by examiner

*Primary Examiner*—Mark S. Graham

(57) ABSTRACT

A disc tossing game for tossing discs into bores of a board. The disc tossing game includes a (game and method of playing the same. The game includes a first board, a second board and a plurality of discs. The first board has three bores therein. The bores are generally aligned. The second board is substantially identical to the first board. Point indicia is located on the first and second boards and is adjacent to each of the bores. The indicia adjacent to a first outside bore indicating five points. The indicia adjacent to the middle bore indicating three points. The indicia adjacent to the second outside bore indicating one point. A plurality of discs are used for tossing into the bores. Two players or two pairs of players may play. The first board is placed approximately ten feet from the second board. The players stand on an edge of one of the boards and toss the rings toward the bores in the other of the boards. Each player or pair of players tosses four of the discs. Each turn of four tosses defines a series. All points are added as indicated by the indicia corresponding to each bore has a first player's disc in. One point is received for having all four discs on the board. The game is wone by acquiring twenty-one points and hitting the board with any remaining discs for that series.

2 Claims, 2 Drawing Sheets

DISC TOSSING GAME

BACKGROUND OF THE INVENTION

1. Field of the Invention

The present invention relates to tossing games and more particularly pertains to a new disc tossing game for tossing discs into bores of a board.

2. Description of the Prior Art

The use of tossing games is known in the prior art. More specifically, tossing games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,936,590; U.S. Pat. No. 4,974,858; U.S. Pat. No. 5,575,480; U.S. Pat. No. 5,382,028; U.S. Pat. Des. No. 369,188; and U.S. Pat. No. 4,927,161.

While these devices fulfill their respective, particular objectives and requirements, the aforementioned patents do not disclose a new disc tossing game. The inventive device includes a game and method of playing the same. The game includes a first board, a second board and a plurality of discs. The first board has three bores therein. The bores are generally aligned. The second board is substantially identical to the first board. Point indicia is located on the first and second boards and is adjacent to each of the bores. The indicia adjacent to a first outside bore indicating five points. The indicia adjacent to the middle bore indicating three points. The indicia adjacent to the second outside bore indicating one point. A plurality of discs are used for tossing into the bores. Two players or two pairs of players may play. The first board is placed approximately ten feet from the second board. The players stand on an edge of one of the boards and toss the rings toward the bores in the other of the boards. Each player or pair of players tosses four of the discs. Each turn of four tosses defines a series. All points are added as indicated by the indicia corresponding to each bore has a first player's disc in. One point is received for having all four discs on the board. The game is wone by acquiring twenty-one points and hitting the board with any remaining discs for that series.

In these respects, the disc tossing game according to the present invention substantially departs from the conventional concepts and designs of the prior art, and in so doing provides an apparatus primarily developed for the purpose of playing a game involving tossing discs into bores of a board.

SUMMARY OF THE INVENTION

In view of the foregoing disadvantages inherent in the known types of tossing games now present in the prior art, the present invention provides a new disc tossing game construction wherein the same can be utilized for tossing discs into bores of a board.

The general purpose of the present invention, which will be described subsequently in greater detail, is to provide a new disc tossing game apparatus and method which has many of the advantages of the tossing games mentioned heretofore and many novel features that result in a new disc tossing game which is not anticipated, rendered obvious, suggested, or even implied by any of the prior art tossing games, either alone or in any combination thereof.

To attain this, the present invention generally comprises a game and method of playing the same. The game includes a first board, a second board and a plurality of discs. The first board has three bores therein. The bores are generally aligned. The second board is substantially identical to the first board. Point indicia is located on the first and second boards and is adjacent to each of the bores. The indicia adjacent to a first outside bore indicating five points. The indicia adjacent to the middle bore indicating three points. The indicia adjacent to the second outside bore indicating one point. A plurality of discs are used for tossing into the bores. Two players or two pairs of players may play. The first board is placed approximately ten feet from the second board. The players stand on an edge of one of the boards and toss the rings toward the bores in the other of the boards. Each player or pair of players tosses four of the discs. Each turn of four tosses defines a series. All points are added as indicated by the indicia corresponding to each bore has a first player's disc in. One point is received for having all four discs on the board. The game is wone by acquiring twenty-one points and hitting the board with any remaining discs for that series.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new disc tossing game apparatus and method which has many of the advantages of the tossing games mentioned heretofore and many novel features that result in a new disc tossing game which is not anticipated, rendered obvious, suggested, or even implied by any of the prior art tossing games, either alone or in any combination thereof.

It is another object of the present invention to provide a new disc tossing game which may be easily and efficiently manufactured and marketed.

It is a further object of the present invention to provide a new disc tossing game which is of a durable and reliable construction.

An even further object of the present invention is to provide a new disc tossing game which is susceptible of a low cost of manufacture with regard to both materials and labor, and which accordingly is then susceptible of low prices of sale to the consuming public, thereby making such disc tossing game economically available to the buying public.

Still yet another object of the present invention is to provide a new disc tossing game which provides in the apparatuses and methods of the prior art some of the advantages thereof, while simultaneously overcoming some of the disadvantages normally associated therewith.

Still another object of the present invention is to provide a new disc tossing game for tossing discs into bores of a board.

Yet another object of the present invention is to provide a new disc tossing game which includes a game and method of playing the same. The game includes a game and method of playing the same. The game includes a first board, a second board and a plurality of discs. The first board has three bores therein. The bores are generally aligned. The second board is substantially identical to the first board. Point indicia is located on the first and second boards and is adjacent to each of the bores. The indicia adjacent to a first outside bore indicating five points. The indicia adjacent to the middle bore indicating three points. The indicia adjacent to the second outside bore indicating one point. A plurality of discs are used for tossing into the bores. Two players or two pairs of players may play. The first board is placed approximately ten feet from the second board. The players stand on an edge of one of the boards and toss the rings toward the bores in the other of the boards. Each player or pair of players tosses four of the discs. Each turn of four tosses defines a series. All points are added as indicated by the indicia corresponding to each bore has a first player's disc in. One point is received for having all four discs on the board. The game is wone by acquiring twenty-one points and hitting the board with any remaining discs for that series.

Still yet another object of the present invention is to provide a new disc tossing game that offers a challenging game that can be played by all ages.

Even still another object of the present invention is to provide a new disc tossing game that has variable degrees of difficulty by adjusting the length between the first and second boards.

Yet another object of the present invention is to provide a new tossing game which is safe because of the absence of sharp objects so that it can be enjoyed by players of all ages.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
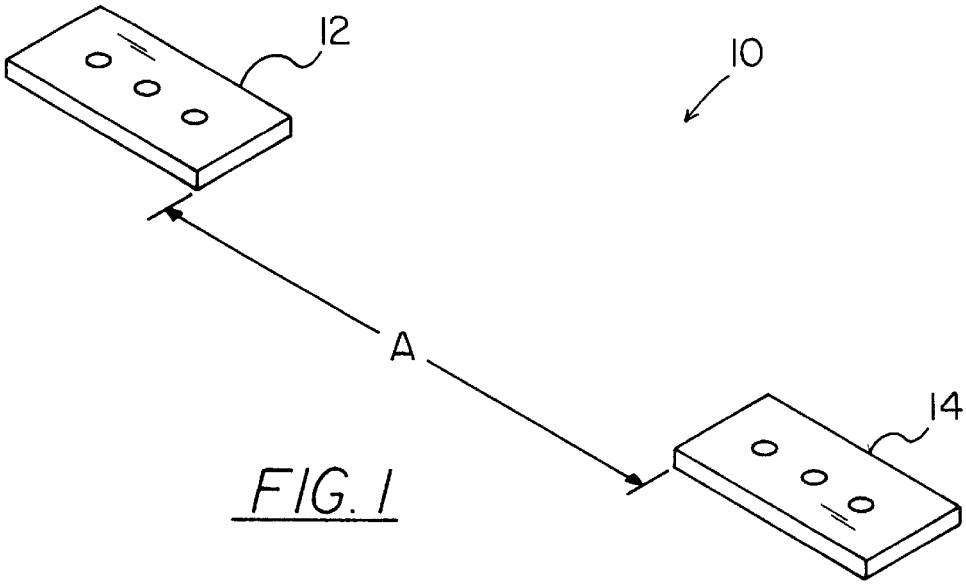
FIG. 1 is a schematic perspective view of the boards of a new disc tossing game according to the present invention.
Figure 2:
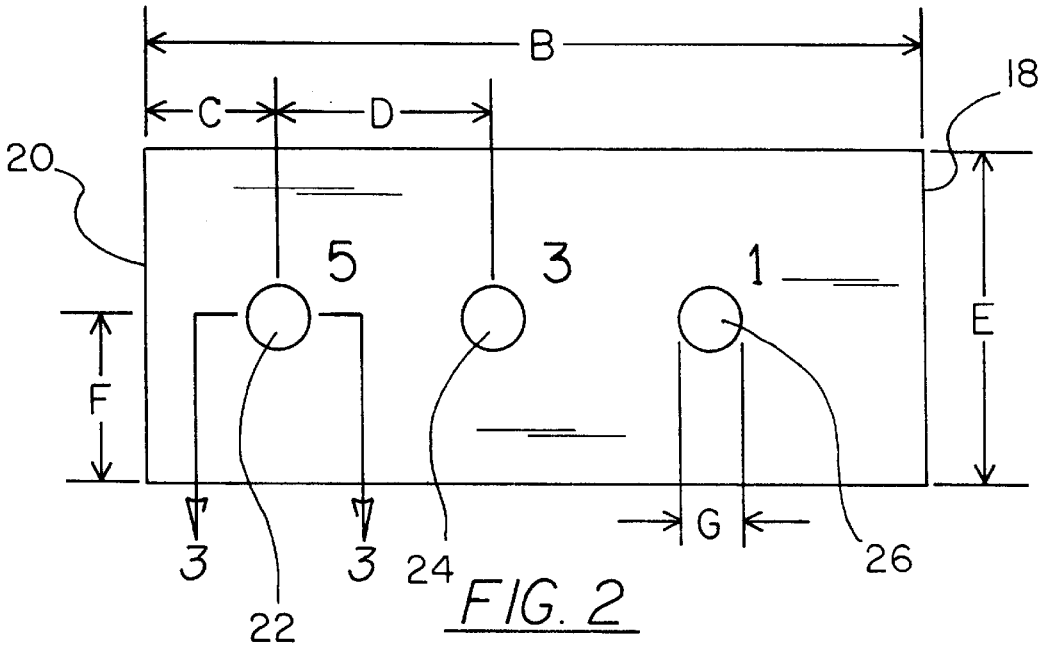
FIG. 2 is a schematic plan view of the boards of the present invention.
Figure 3:
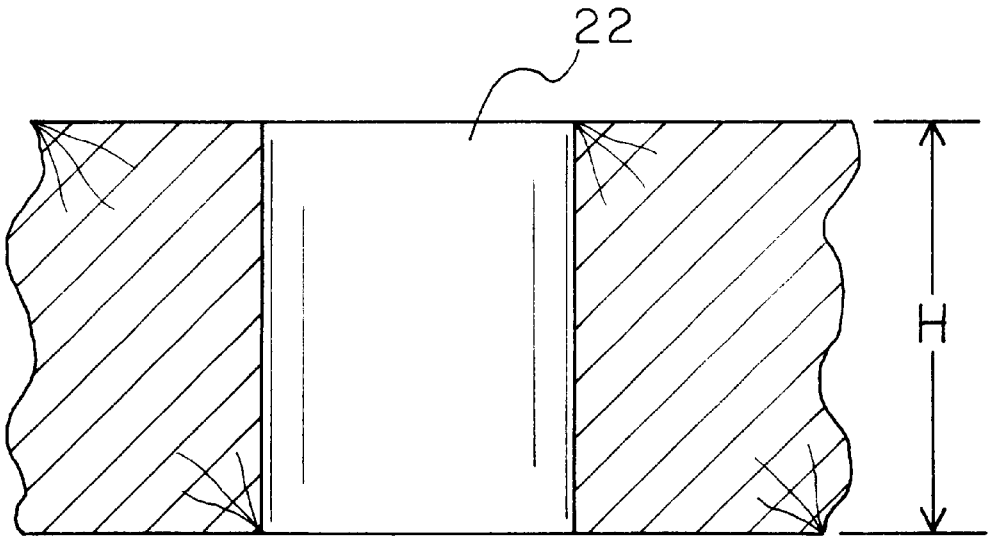
FIG. 3 is a schematic cross-sectional view taken along line 3—3 of the present invention.
Figure 4:
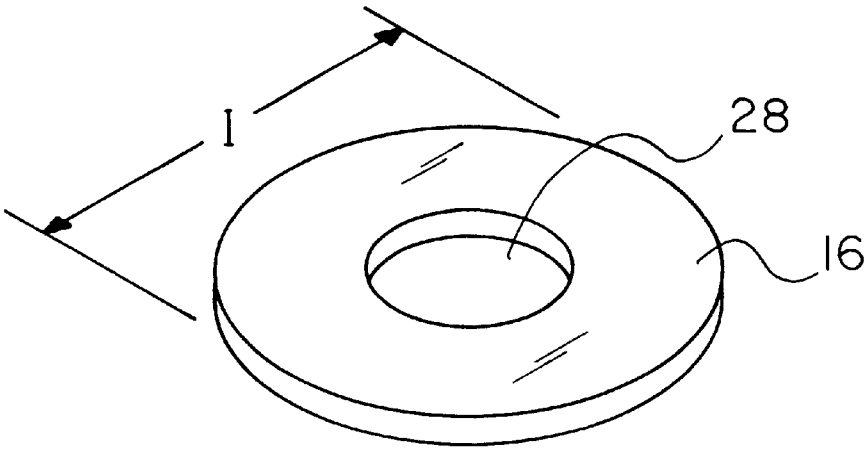
FIG. 4 is a schematic perspective view the disc of the present invention.

With reference now to the drawings, and in particular to FIGS. 1 through 4 thereof, a new disc tossing game embodying the principles and concepts of the present invention and generally designated by the reference numeral 10 will be described.

As best illustrated in FIGS. 1 through 4, the disc tossing game 10 generally comprises a first board 12, a second board 14 and plurality of discs 16.

The first board 12 is generally rectangular. The first board has first 18 and second 20 opposite edges. The first board has a longitudinal axis such that the longitudinal axis generally bisects the first 18 and second edges 20. The first board 12 has three bores therein. The bores are generally aligned, each being generally bisected by the longitudinal axis of the board 12. Ideally, a length "C" between an axis of the first bore 22 and the second edge 20 of the first board 12 is substantially equal to eight inches. A length "D" between an axis of the first bore 22 and an axis of the second bore 24 is substantially equal to thirteen inches. A length between an axis of the second bore 24 and an axis of the third bore 26 is substantially equal to thirteen inches. Each of the bores has a diameter "G" approximately equal to four inches. A length "B" of the first board 12 is approximately equal to four feet.

The second board 14 is substantially identical to the first board 12.

Point indicia indicates points on the first 12 and second 14 boards. The indicia are adjacent to each of the bores. The indicia adjacent to the first bore 22 indicate five points. The indicia adjacent to the second bore 24 indicate three points. The indicia adjacent to the third bore 26 indicate one point.

A plurality of discs 16 is used for tossing into the bores. Each of the discs 16 has a bore 28 therein, and each of the discs 16 is generally planar. The discs are annular. Ideally, each of the discs has a diameter "I" approximately equal to two and one-half inches.

Rules of Game

Two players or two pairs of players can play. If pairs are used, one player from each team stands next to one of the boards 12, 14 and tosses the discs toward the other bore.

The first edge 18 of the first board 12 is placed a distance "A", preferably approximately ten feet, from a first edge of the second board 14 such that the first edges are opposing.

The player tossing the disc 16 stands on an edge of one of the boards 12 and tosses the discs 16 toward the other board 14.

The players toss the discs 16 toward the bores in the other of the boards. Each player or pair of players tosses four of the discs 16. Each turn of four tosses defines a series.

Points are accumulate according to the following formula.

All points are added as indicated by the indicia corresponding to each bore 22, 24, 26 has a first player's disc 16 therein.

Opponents+ discs 16 within the same bore cancel each other in a one-to-one ratio such that a series score is defined. The series scores are summed to define an accumulated score.

Players receive one point for having all four discs 16 on the board 12, 14 at once. If a disc 16 is in a bore, that disc does not count as being on the board.

The series score is subtracted from the accumulated score if summing the series score to the accumulated score is greater than twenty-one points.

The game is won by acquiring twenty-one points and hitting the board with any remaining discs for that series. If the player scores 21 and has discs 16 remaining, but does not hit the board 12, 14 with the remaining discs, the player gains no points on that throw.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method of playing a game, comprising the steps of:

providing a first board, said first board having three bores therein, said bores being generally aligned, wherein said first board is generally rectangular, said first board having a first and second edge, said first and second edges being opposite edges, said first board having a longitudinal axis such that said longitudinal axis generally bisects said first and second edges, said first board having three bores therein, said bores being generally aligned, each of said bores being generally bisected by said longitudinal axis of said board;

providing a second board, said second board being substantially identical to said first board;

providing point indicia on said first and second boards, said indicia being adjacent to each of said bores, said indicia adjacent to a first outside bore indicating five points, said indicia adjacent to a middle bore indicating three points, said indicia adjacent to said a second outside bore indicating one point;

providing a plurality of discs for tossing into said bores, wherein each of said discs has a bore therein, each of said discs being generally planar, each of said discs being annular;

providing two players or two pairs of players;

placing said first board approximately ten feet from said second board;

standing on an edge of one of said boards;

tossing said discs toward the bores in the other of said boards, wherein each player or pair of players tosses four of said discs, wherein each turn of four tosses defines a series;

accumulating points, the step of accumulating points comprises:

adding all points as indicated by said indicia corresponding to each bore having a first player's disc therein, receiving one point for having all four discs on said board;

canceling any scoring of opponents+ discs located in the same bore in a one to one ratio such that a series score is defined;

summing said series scores to define an accumulated score; and subtracting said series score from said accumulated score if summing said series score to said accumulated score is greater than twenty-one points;

winning the game by acquiring twenty-one points and hitting the board with any remaining discs for that series.

2. A method of playing a game, comprising the steps of:

providing a first board, said first board being generally rectangular, said first board having a first and second edge, said first and second edges being opposite edges, said first board having a longitudinal axis such that said longitudinal axis generally bisects said first and second edges, said first board having three bores therein comprising first, second, and third bores, said bores being generally aligned, each of said bores being generally bisected by said longitudinal axis of said board, a length between an axis of said first bore and said second edge of said first board being substantially equal to eight inches, a length between an axis of said first bore and an axis of said second bore being substantially equal to thirteen inches, a length between an axis of said second bore and an axis of said third bore being substantially equal to thirteen inches, each of said bores having a diameter approximately equal to four inches, a length of said first board being approximately equal to four feet;

providing a second board, said second board being substantially identical to said first board;

providing point indicia on said first and second boards, said indicia being adjacent to each of said bores, said indicia adjacent to said first bore indicating five points, said indicia adjacent to said second bore indicating three points, said indicia adjacent to said third bore indicating one point;

providing a plurality of discs for tossing into said bores, each of said discs having a bore therein, each of said discs being generally planar, each of said discs being annular, each of said discs having a diameter approximately equal to two and onehalf inches;

providing two players or two pairs of players;

placing said first edge of said first board approximately ten feet from a first edge of said second board such that said first edges are opposing;

standing on an edge of one of said boards;

tossing said discs toward the bores in the other of said boards, wherein each player or pair of players tosses four of said discs, wherein each turn of four tosses defines a series;

accumulating points, the step of accumulating points comprises:

adding all points as indicated by said indicia corresponding to each bore having a first player's disc therein, receiving one point for having all four discs on said board;

canceling any scoring of opponents+ discs located in the same bore in a one to one ratio such that a series score is defined;

summing said series scores to define an accumulated score; and subtracting said series score from said accumulated score if summing said series score to said accumulated score is greater than twenty-one points; and winning the game by acquiring twenty-one points and hitting the board with any remaining discs for that series.

* * * * *